US005190676A

United States Patent [19]

Yamane et al.

[11] Patent Number: 5,190,676

[45] Date of Patent: Mar. 2, 1993

[54] HIGH-SPEED SPINNING OIL COMPOSITION CONTAINING AN ORGANOPHOSHURIC ESTER SALT AND AN OXYALKYLENE POLYMER

[75] Inventors: Koichi Yamane; Masayuki Abe, both of Wakayama, Japan

[73] Assignee: Kao Corporation, Tokyo, Japan

[21] Appl. No.: 620,110

[22] Filed: Nov. 30, 1990

[30] Foreign Application Priority Data

Nov. 30, 1989 [JP] Japan ..... 1-312531

[51] Int. Cl.[5] ..... D06M 10/08

[52] U.S. Cl. ..... 252/8.9; 252/8.6; 252/8.7; 252/8.75

[58] Field of Search ..... 252/8.9, 6.6, 8.7, 8.75

[56] References Cited

U.S. PATENT DOCUMENTS

| | | | |
|---|---|---|---|
| 2,838,455 | 6/1958 | Tompkins | 252/8.6 |
| 2,839,464 | 6/1958 | Sproule et al. | 252/8.9 |
| 3,338,830 | 8/1967 | Stokes et al. | 252/8.9 |
| 3,493,504 | 2/1970 | Buckley | 252/8.8 |
| 3,639,235 | 2/1972 | Karg | 252/8.75 |
| 3,652,419 | 3/1972 | Karg | 252/8.8 |
| 3,926,816 | 12/1975 | Cohen et al. | 252/8.9 |
| 3,957,661 | 5/1976 | Vérité252 | 8.9/ |
| 3,963,628 | 6/1976 | Park | 252/8.8 |
| 4,169,061 | 9/1979 | Carver et al. | 252/8.9 |
| 4,242,095 | 12/1980 | Carver | 8/115.6 |
| 4,351,738 | 9/1982 | Takahashi et al. | 252/8.75 |
| 4,816,336 | 3/1989 | Allou, Jr. et al. | 428/361 |
| 4,975,091 | 12/1990 | Becker et al. | 8/115.66 |

FOREIGN PATENT DOCUMENTS

| | | |
|---|---|---|
| 342331 | 11/1989 | European Pat. Off. . |
| 0197355 | 9/1990 | European Pat. Off. . |
| 52-53097 | 4/1977 | Japan . |
| 0031897 | 3/1978 | Japan . |
| 0103099 | 9/1978 | Japan . |
| 56-79769 | 6/1981 | Japan . |
| 56-140178 | 11/1981 | Japan . |
| 0140179 | 11/1981 | Japan . |
| 8046179 | 3/1983 | Japan . |
| 59-066575 | 4/1984 | Japan . |
| 0100765 | 6/1984 | Japan . |
| 0181368 | 9/1985 | Japan . |
| 60-224868 | 11/1985 | Japan . |
| 61-124680 | 6/1986 | Japan . |
| 61-252370 | 11/1986 | Japan . |
| 2078267 | 4/1987 | Japan . |
| 2078268 | 4/1987 | Japan . |
| 62-223380 | 10/1987 | Japan . |
| 1306684 | 12/1989 | Japan . |

OTHER PUBLICATIONS

Research Disclosure, vol. 143, No. 12, Mar. 1977, p. 9, "Finish for Textile Fibers".

WPIL, File Supplier, Derwent Publications Ltd., AN=84-104474 & JP-A-59 147478 (Kao Corp.) Mar. 17, 1984.

WPIL, File Supplier, Derwent Publications Ltd., AN=87-316605 & JP-A-62 223380 (Kanebo KK) Oct. 10, 1987 French Search Report.

*Primary Examiner*—A. Lionel Clingman
*Assistant Examiner*—William S. Parks
*Attorney, Agent, or Firm*—Sughrue, Mion, Zinn, Macpeak & Seas

[57] ABSTRACT

A high-speed spinning oil composition is disclosed, which comprises following components (A) and (B):

(A) an organophosphoric ester salt of formula (1):

$$M^{30}X^- \quad (1)$$

wherein $M^+$ is an alkali metal ion, ammonium ion or an amine ion; $X^-$ is an organophosphoric ester anion of formula (2):

$$(R_1-O-(AO)_a)_b-\overset{\overset{\displaystyle O}{\|}}{P}-(OH)_{3-b} \quad (2)$$

wherein $R_1$ is an alkyl or alkenyl group of 8 to 22 carbon atoms; A is an alkylene group of 2 to 4 carbon atoms; a is a whole number of 0 to 22; and b is equal to 1 or 2; and (B) an oxyalkylene polymer of formula (3):

$$R_{11}-O-(AO)_nH \quad (3)$$

wherein $R_{11}$ is a hydrogen atom, an alkyl or alkenyl group of 1 to 20 carbon atoms, an acyl group of 2 to 22 carbon atoms, an aryl group, a polyhydric alcohol group or a silyl group; A is an alkylene group of 2 to 4 carbon atoms; the oxyalkylene polymer has a molecular weight of 2,000 to 40,000.

The high-speed spinning oil composition of the present invention is excellent in resistance to friction against metal and prevents yarn breakage and deradation in high-speed spinning.

1 Claim, No Drawings

HIGH-SPEED SPINNING OIL COMPOSITION CONTAINING AN ORGANOPHOSHURIC ESTER SALT AND AN OXYALKYLENE POLYMER

FIELD OF THE INVENTION

The present invention relates to a spinning oil composition for synthetic fiber. More particularly, the present invention relates to a high-speed spinning oil composition for synthetic fiber, which is capable of reducing the incidence of yarn breakage due to high-speed frictional travel of filaments, for example, on the balloon control ring of a ring spinning machine

BACKGROUND OF THE INVENTION

The spinning process comprises a series of steps such as opening, carding, drawing, roving and spinning and the fiber thus passes through many a processing stage. The characteristics required of a spinning oil vary with different steps and any spinning oil must meet these varied requirements. Therefore, the conventional spinning oils were primarily designed to satisfy these spinning characteristics, namely, improvements in opening and drawing characteristics and antistatic property.

However, in the face of fierce competition today, the rationalization and speed-up of the spinning operation are absolute necessities. Particularly, the ring spinning process in which the twisting speed, i.e., the rotational speed of the spindle, is a major parameter is a rate-determining step and, therefore, the speed-up of this ring spinning process has been keenly demanded.

Ring spinning is excellent in terms of yarn quality but because of the mechanism involved, the friction between the balloon control ring and staple fiber at high speed is inevitable and any effort to meet the demand for speed-up is seriously restrained by the possible incidence of troubles such as uneven dyeing, napping and yarn breakage.

Therefore, some novel systems such as open-end spinning, air-jet spinning, etc. have been proposed. However, while these new techniques offer high spinning speeds, they are not sufficient to insure fully satisfactory yarn qualities.

SUMMARY OF THE INVENTION

The present inventors made extensive studies for reducing the incidence of yarn breakage in the ring spinning stage and found that the combined use of an organophosphoric ester salt, which is not only excellent in thermal stability and extreme pressure characteristic but also is a good antistatic agent, and an oxyalkylene polymer results in a marked decrease in high-speed friction in the ring spinning stage and, thus, enables to provide a spinning oil composition showing excellent spinning characteristics.

Accordingly, the present invention provides a high-speed spinning oil composition comprising the following components (A) and (B):

(A) an organophosphoric ester salt represented by the formula (1):

$$M^+X^- \quad (1)$$

wherein $M^+$ represents an alkali metal ion, ammonium ion or an amine ion; and $X^-$ represents an anion of an organophosphoric ester represented by formula (2):

$$(R_1-O-(AO)_a)_b-\overset{\overset{\displaystyle O}{\|}}{P}-(OH)_{3-b} \quad (2)$$

wherein $R_1$ represents an alkyl or alkenyl group having 8 to 22 carbon atoms; A represents an alkylene group having 2 to 4 carbon atoms; a represents an integer of from 0 to 22; and b is a number equal to 1 or 2; and (B) an oxyalkylene polymer represented by following formula (3):

$$R_{11}-O-(AO)_nH \quad (3)$$

wherein $R_{11}$ is a hydrogen atom, an alkyl or alkenyl group having 1 to 20 carbon atoms, an acyl group having 2 to 22 carbon atoms, an aryl group, a polyhydric alcohol group or a silyl group; A represents an alkylene group having 2 to 4 carbon atoms; and the oxyalkylene polymer has a molecular weight of 2,000 to 40,000.

DETAILED DESCRIPTION OF THE INVENTION

Although the detailed mechanism of decrease in the incidence of yarn breakage during ring spinning stage is not fully elucidated, it is presumed that the lubricating oil film has to keep formed at a high speed (2,000 mpm) without causing cut off of the oil film even if its thickness is decreased and the lubricating oil component has to be flowing into the site of friction to supply the site with the lubricating component. To suffice the former requirement, the use of a high molecular weight compound is preferred, while a linear molecule is useful for sufficing the latter requirement.

JP-A-62-223380 (the term "JP-A" as used herein means "unexamined published Japanese Patent Application") in which a polyoxyalkylene polymer is used proposes to apply this compound into an acrylic fiber in the stage of a wet-spinning process where it remains to attain a definite fiber form but is still in the form of gels to prevent hang-up in the course of polymer formation. In regard to the apprehension that this compound might adversely affect spinnability, the use of it in combination with the conventional spinning oil was explored and the conclusion was reached that it does not present any problem if the amount of the compound is critically controlled.

However, the extensive studies by the present inventors revealed surprisingly that this compound is very effective in preventing the yarn breakage due to friction against metal at the balloon control ring of the ring spinning machine during high-speed operation and the present inventors positively confirmed the usefulness of the compound as an ingredient of spinning oil composition.

In formula (1) representing the organophosphoric acid ester salt (A) to be used in the present invention, $M^+$ represents an alkali metal ion, such as ions of Li, Na, K and the like metals, ammonium ion, or an amine ion such as ions of monoethanolamine, diethanolamine, triethanolamine, ethylenediamine, diethylenediamine and polyoxyethylenealkylamines represented by the following formula (4):

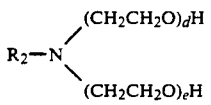

(4)

wherein $R_2$ represents an alkyl or alkenyl group having 8 to 18 carbon atoms; d and e independently represent an integer of from 1 to 10 and the sum of d and e is in the range of from 2 to 19 ($1 < d+e < 20$).

In formula (1) representing the organophosphoric ester salt (A), $X^-$ represents an organophosphoric ester of the following formula (2):

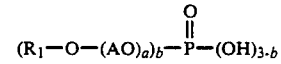

(2)

wherein $R_1$ represents an alkyl or alkenyl group having 8 to 22 carbon atoms; A represents an alkylene group having 2 to 4 carbon atoms; a represents an integer of from 0 to 22; and b is a number equal to 1 or 2. Specific examples of $R_1$ include, for example, octyl, decyl, lauryl, myristyl, palmityl, stearyl, oleyl, behenyl, 2-ethylhexyl and 2-octyldecyl.

The organophosphoric ester of formula (2) can be prepared by esterifying a higher alcohol or an alkylene oxide adduct thereof with a phosphorylating agent such as phosphorus pentoxide, orthophosphoric acid, polyphosphoric acid, phosphorus oxychloride or the like. The higher alcohol-alkylene oxide adduct can be prepared by oxyalkylenating reaction (ethylene oxide addition reaction)using an epoxy compound represented by the following formula (5):

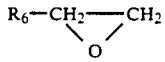

(5)

wherein $R_6$ represents a hydrogen atom or an alkyl group having 1 to 18 carbon atoms.

Specific examples of the organophosphoric ester of formula (2) include sesquioctyl phosphate, sesquidecyl phosphate, sesquilauryl phosphate, sesquimyristyl phosphate, sesquipalmityl phosphate, sesquistearyl phosphate, sesquibehenyl phosphate, sesquioleyl phosphate, sesqui-2-ethylhexyl phosphate, sesqui-2-octyldodecyl phosphate, bis[laurylpolyoxyethylene(8 moles)] phosphate, stearylpolyoxypropylene(3 moles) [(hereinafter referred to as POP (3)] phosphate, bis[lauryl-POP(3)] phosphate and so on. The corresponding mono- and di-esters as well as optional mixtures of the mono- and di-esters can also be employed Referring the polyoxyethylenealkylamine represented by the following formula (4):

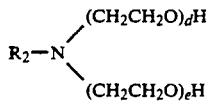

(4)

of amines represented by $M^+$ in the organophosphoric ester salt of formula (1), $R_2$ represents an alkyl or alkenyl group having 8 to 18 carbon atoms. Specific examples thereof includes octyl, decyl, lauryl, myristyl, palmityl, stearyl, oleyl, 2-ethylhexyl, 2-octyldodecyl and so on. Specific examples of polyoxyethylenealkylamines of formula (4) include polyoxyethylene(3 moles) [hereinafter referred to briefly as POE(3)]-octylamine, POE(3)-decylamine, POE(3)-palmitylamine, POE(3)-stearylamine, POE(3)-oleylamine, POE(3)-2-ethylhexylamine, POE(3)-2-octyldodecylamine and so on.

Referring to component B, which is an oxyalkylene polymer of the following formula (3):

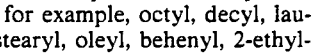

(3)

wherein $R_{11}$ represents a hydrogen atom, an alkyl or alkenyl group having 1 to 20 carbon atoms, an acyl group of 2 to 22 carbon atoms, an aryl group, a polyhydric alcohol group or a silyl group; A represents an alkylene group having 2 to 4 carbon atoms, and which has a molecular weight in the range of 2,000 to 40,000, specific examples of $R_{11}$ include methyl, ethyl, propyl, butyl, amyl, octyl, decyl, lauryl, myristyl, palmityl, stearyl, behenyl, 2-ethylhexyl, 2-octyldodecyl and the like as the alkyl group; acetyl, caproyl, capryloyl, caprinoyl, lauroyl, myristoyl, palmitoyl, stearoyl, oleoyl and the like as the acyl group; nonylphenyl, octylphenyl and the like as the aryl group; and a glycerol residue, a trimethylolpropane residue, a neopentyl glycol residue and the like as the polyhydric alcohol group.

Examples of the epoxy compound to be used for oxyalkylenating reaction (alkylene oxide addition reaction) are ethylene oxide, propylene oxide, butylene oxide and the like.

Specific examples of A in formula (3) include a dimethylene group, a methyldimethylene group, an ethyldimethylene group and so on.

The oxyalkylene polymer of formula (3) may be a random polymer or a block polymer.

The molecular weight of such oxyalkylene polymer is preferably in the range of from 2,000 to 40,000 and, more preferably from 6,000 to 40,000. The molecular weight referred to above is the value found by gel chromatography and corrected using the value of a polystyrene having a known molecular weight (the weight average molecular weight of 10,000) as a reference. If the molecular weight is less than 2,000, the strength of the oil film is low and accordingly the effect of protecting the yarn from frictional damage is decreased. On the other hand, if the molecular weight is too high, the solubility and ease of handling of the oil are sacrificed. Accordingly, the upper limit of molecular weight should be about 40,000.

In practicing the present invention, any desired spinning oil materials, in addition to components (A) and (B) according to the invention, may be incorporated in amounts not inferring the effect of the invention. Such optional materials include, for example, animal or vegetable oils and fats, mineral oils, fatty acid esters, fatty acids, higher alcohols, nonionic surfactants such as ethylene oxidepolyhydric alcohol adducts or fatty acid ester adducts, and so on. It is particularly preferable to incorporate a nonionic surfactant in an amount not adversely affecting spinnability for the purpose of improving the emulsion stability and ease of handling of the spinning oil composition. As the nonionic surfactant, polyoxyethylene alkyl ethers, polyoxyethylene nonylphenyl ethers, ethylene oxide- or propylene oxide-modified silicone activators and so on can be used. The level of addition of such nonionic surfactant is generally less than about 60% and preferably in the range of about 5 to 30%, based on the solid content of the composition.

The spinning oil composition of the present invention is applicable to all kinds of synthetic fiber, including polyesters, polyacrylonitriles, polyamides and other fibers. Since polyacrylonitrile fiber, in particular, are sensitive to high-speed ring spinning conditions, the spinning oil composition of the present invention appears to be especially suited to this type of fiber.

When the dipping method is employed, the spinning oil of the present invention can be used advantageously as an aqueous emulsion of about 0.5 to 5% by weight concentration as usual, although it can be used by the roller contact method or the spray method.

The amount of deposition of the spinning oil composition on the fiber is generally about 0.01 to 1% owf and preferably about 0.1 to 0.8% owf.

The proportion of the organophosphoric ester salt (A) in the spinning oil composition of the present invention based on the solid content thereof is about 5 to 80% by weight and preferably about 10 to 40% by weight. If the proportion of component (A) is less than about 5% by weight, the antistaticity and extreme pressure characteristics will be inadequate, while the use of component (A) in excess of about 80% by weight results in troubles such as excessive bundling force. The proportion of the oxyalkylene polymer (B) based on the solid content of the spinning oil composition is about 5 to 70% by weight and preferably about 10 to 40% by weight. If the proportion of component (B) is less than about 5% by weight, the effect of preventing abrasive yarn damage will be inadequate, while the use of component (B) in excess of about 70% by weight leads to a deficiency in bundling force to cause an increased incidence of yarn breakage.

The following examples are further illustrative of the present invention and not by way of limitation. Unless otherwise indicated, all percents therein are by weight.

EXAMPLE 1

An acrylic fiber staple fiber (1.7 d, 38 mm) defatted with a solvent was dipped in a 0.5% solution of a compound shown in Table 2 in ethanol-methylene chloride and dried at 60° C. for 2 hours. This lubricated staple fiber was conditioned for 24 hours, after which it was test-spun with a spinning tester (manufactured by Platt Co.).

The frictional damage at the balloon control ring in the spinning process was investigated and rated as follows.

The spinning tester was modified so that its spindle speed could be readily varied using an electric motor equipped with a stepless speed-change device.

Using this spinning tester, spun yarns were test-spun from the staples treated with the various oiling compounds indicated in Table 2 and the naps produced in the spinning process were counted under the microscope and the rotational speed at which about 2,000 naps were produced per 100 m of spun yarn was recorded as the critical speed. For convenience's sake, the critical speed was expressed in the number of revolutions per minute of the motor. The correspondence between this critical speed and the spindle speed of the spinning machine was assumed to be as shown below in Table 1.

TABLE 1

| Critical speed (rpm) | Spindle speed of spinning machine (rpm) |
|---|---|
| 2000 | 8000 |
| 2500 | 10000 |

TABLE 1-continued

| Critical speed (rpm) | Spindle speed of spinning machine (rpm) |
|---|---|
| 3000 | 12000 |
| 4000 | 16000 |
| 4500 | 18000 |
| 5000 | 20000 |

The results of evaluation are set forth in Table 2.

TABLE 2

| No. | Compound | Critical speed |
|---|---|---|
| 1 | EOPO random polymer (m.w.: 1000) | 2800 |
| 2 | EOPO random polymer (m.w.: 2000) | 3500 |
| 3 | EOPO random polymer (m.w.: 6000) | 4000 |
| 4 | EOPO random polymer (m.w.: 10000) | 4100 |
| 5 | EOPO random polymer (m.w.: 15000) | 4100 |
| 6 | EOPO block polymer (m.w.: 1000) | 2800 |
| 7 | EOPO block polymer (m.w.: 2000) | 3500 |
| 8 | EOPO block polymer (m.w.: 6000) | 4000 |
| 9 | EOPO block polymer (m.w.: 10000) | 4100 |
| 10 | EOPO block polymer (m.w.: 15000) | 4100 |
| 11 | Sesquihexyl phosphate K salt | 3500 |
| 12 | Sesquioctyl phosphate K salt | 3800 |
| 13 | Sesquilauryl phosphate K salt | 4200 |
| 14 | Sesquimyristyl phosphate K salt | 4200 |
| 15 | Sesquipalmityl phosphate K salt | 4300 |
| 16 | Sesquistearyl phosphate K salt | 4400 |

Note: in each of the polymers (No. 1-No. 10), $R_{11}$ is a hydrogen atom.

It is apparent from Table 2 that the higher the molecular weight of the oxyalkylene polymer, the higher is the critical speed (better suited for high-speed spinning), that no satisfactory high-speed spinning performance can be realized when the molecular weight of the oxyalkylene polymer is less than 2,000, and that no further improvement can be expected when the molecular weight exceeds 10,000. It is also seen that substantially no difference in effect between the ethylene oxide/propylene oxide block and random polymers.

With regard to the phosphate, the longer the carbon chain within the range of 5 to 18 carbon atoms, the higher is the critical speed as a tendency.

EXAMPLE 2

In this example, the interaction between the oxyalkylene polymer and the phosphate was investigated.

Thus, the oxyalkylene polymers and phosphates indicated in Table 3 were applied to acrylic fiber in the same manner as in Example 1 and the respective fiber samples were subjected to the same spinning test as described in Example 2.

The mixing rations of oxyalkylene polymer to phosphate were invariably 50/50 by weight.

The results are shown in Table 3.

TABLE 3

Synergism between organophosphoric ester salt and oxyalkylene polymer

| No. | Organophosphoric ester salt | Polymer | Critical speed (rpm) |
|---|---|---|---|
| | Comparative Product | | |
| 17 | Sesquihexyl phosphate K salt | Polymer P | 3500 |
| 18 | Sesquihexyl phosphate K salt | Polymer Q | 3500 |
| 19 | Sesquilauryl phosphate K salt | Polymer A | 3800 |
| 20 | Sesquilauryl phosphate K salt | Polymer B | 3500 |
| 21 | Sesquilauryl phosphate K salt | Polymer C | 3600 |
| | Product of the Invention | | |
| 22 | Sesquioctyl phosphate K salt | Polymer P | 4300 |
| 23 | Sesquilauryl phosphate K salt | Polymer P | 4400 |
| 24 | Sesquimyristyl phosphate K salt | Polymer P | 4400 |

TABLE 3-continued

| Synergism between organophosphoric ester salt and oxyalkylene polymer | | | |
|---|---|---|---|
| No. | Organophosphoric ester salt | Polymer | Critical speed (rpm) |
| 25 | Sesquipalmityl phosphate K salt | Polymer P | 4600 |
| 26 | Sesquistearyl phosphate K salt | Polymer P | 5000 |
| 27 | Sesquioctyl phosphate K salt | Polymer Q | 4000 |
| 28 | Sesquilauryl phosphate K salt | Polymer Q | 4400 |
| 29 | Sesquimyristyl phosphate K salt | Polymer Q | 4400 |
| 30 | Sesquipalmityl phosphate K salt | Polymer Q | 4600 |
| 31 | Sesquistearyl phosphate K salt | Polymer Q | 5000 |
| 32 | Dilauryl phosphate K salt | Polymer P | 3800 |
| 33 | Monolauryl phosphate K salt | Polymer P | 4300 |
| 34 | Sesquilauryl phosphate $NH_4$ salt | Polymer P | 4000 |
| 35 | Sesquilauryl phosphate monoethanolamine | Polymer P | 4200 |
| 36 | Sesquilauryl phosphate diethanolamine | Polymer P | 4100 |
| 37 | Sesquilauryl phosphate triethanolamine | Polymer P | 3900 |
| 38 | Sesquilauryl phosphate amine A | Polymer P | 4000 |
| 39 | Sesquilauryl phosphate K salt | Polymer R | 5000 |
| 40 | Sesquistearyl phosphate K salt | Polymer S | 5000 |
| 41 | Sesquistearyl phosphate K salt | Polymer T | 5000 |

Notes:
Polymer A: EOPO random polymer ($R_{11}$ is a hydrogen atom) (m.w.: 1,000)
Polymer B: EOPO random polymer ($R_{11}$ is a hydrogen atom) (m.w.: 1,500)
Polymer C: $C_{12}H_{25}$(EO)(PO) random polymer (m.w.: 1,500)
Amine A: Polyoxyethylene (3) - laurylamine
Polymer P: EOPO random polymer ($R_{11}$ is a hydrogen atom) (m.w.: 10,000)
Polymer Q: $H(EO)_m(PO)_n(EO)_nH$ block polymer (m.w.: 10,000)
Polymer R: $C_{12}H_{25}$(EO)(PO) random polymer (m.w.: 10,000)
Polymer S: Nonylphenyl-EOPO random polymer (m.w.: 10,000)
Polymer T: EOPOBO random polymer ($R_{11}$ is a hydrogen atom) (m.w.: 10,000)

It is apparent from Table 3 that compared with Example 1 in which the respective compounds were used independently, the high-speed spinnability has been improved by about 500 rpm on the whole in this example, thus demonstrating the meritorious effect of the invention.

It is also clear that satisfactory results are obtained when the oxyalkylene polymer is lauryl ether- or nonylphenyl ether-terminated (Nos. 39 and 40) or when the alkylene group is EOPOBO (BO: butylene oxide) (No. 41).

EXAMPLE 3

The overall effect of a spinning oil of the following composition on spinning operation was investigated.

| Spinning oil formula: | |
|---|---|
| Mineral oil | 10% |
| Hydrogenated castor oil-ethylene oxide adduct | 20% |
| Sesquistearyl phosphate K salt | 55% |
| EOPO random polymer ($R_{11}$ is a hydrogen atom) (m.w.: 10,000) | 15% |

Using the above spinning oil, acrylic fiber was lubricated and its spinnability evaluated as in Example 1.

As a result, there was no trouble at all throughout the entire spinning course, inclusive of card charge voltage and passability and binding of the fiber to the roller. Furthermore, the critical speed was 4,500 rpm, indicating that the fiber shows excellent high-speed spinnability.

It is, thus, apparent that the spinning oil composition of the present invention is excellent in resistance to friction against metal and that, therefore, it prevents yarn breakage and degradation in high-speed spinning.

While the invention has been described in detail and with reference to specific examples thereof, it will be apparent to one skilled in the art that various changes and modifications can be made therein without departing from the spirit and scope thereof.

What is claimed is:

1. A method for spinning a polyester fiber or acrylic fiber, which comprises applying a high-speed spinning composition to the fiber, wherein the composition consists essentially of components (A), (B) and (C):

(A) an organophosphoric ester salt represented by formula (1):

$$M^+X^- \quad (1)$$

wherein $M^+$ represents an alkali metal ion, ammonium ion or an amine ion; and $X^-$ represents an anion of an organophosphoric ester represented by formula (2):

$$(R_1-O-(AO)_a)_b-\overset{\overset{\displaystyle O}{\|}}{P}-(OH)_{3-b} \quad (2)$$

wherein $R_1$ represents an alkyl or alkenyl group having 8 to 22 carbon atoms; A represents an alkylene group having 2 to 4 carbon atoms; a represents an integer of from 0 to 22; and b is a number equal to 1 or 2;

(B) an oxyalkylene polymer represented by formula (3):

$$B_{11}-0-(AO)_nH \quad (3)$$

wherein $R_{11}$ is a hydrogen atom, an alkyl or alkenyl group having 1 to 20 carbon atoms, an acyl group having 2 to 22 carbon atoms, an aryl group, a polyhydric alcohol group or a silyl group; A represents an alkylene group having 2 to 4 carbon atoms; said oxyalkylene polymer has a molecular weight of 2,000 to 40,000; and (C) a nonionic surfactant;

wherein said components (A) and (B) are contained in proportions of about 5 to 80% by weight and about 5 to 70% by weight, respectively, based on the solid content of the composition.

* * * * *